US009730510B1

(12) United States Patent
Arbos

(10) Patent No.: US 9,730,510 B1
(45) Date of Patent: Aug. 15, 2017

(54) NECK DUSTER WITH A DISPOSABLE BRISTLE ATTACHMENT

(71) Applicant: Miguel Arbos, Fayetteville, NC (US)

(72) Inventor: Miguel Arbos, Fayetteville, NC (US)

( * ) Notice: Subject to any disclaimer, the term of this patent is extended or adjusted under 35 U.S.C. 154(b) by 0 days.

(21) Appl. No.: 15/212,741

(22) Filed: Jul. 18, 2016

(51) Int. Cl.
*A46B 7/04* (2006.01)
*A46B 9/02* (2006.01)

(52) U.S. Cl.
CPC ..... *A46B 7/042* (2013.01); *A46B 9/026* (2013.01)

(58) Field of Classification Search
CPC ..... A46B 7/042; A46B 9/026; A46B 9/028
See application file for complete search history.

(56) References Cited

U.S. PATENT DOCUMENTS 1,493,848 A * 5/1924 Ebert ..... A46B 15/00 15/176.6
2,748,414 A 6/1956 Glunt
3,222,705 A 12/1965 Peterka
4,890,349 A * 1/1990 Nitzsche ..... A46B 7/04 15/167.1
8,230,543 B2 7/2012 Shrier et al.

FOREIGN PATENT DOCUMENTS

FR 3 036 596 * 12/2016

* cited by examiner

*Primary Examiner* — Randall Chin
(74) *Attorney, Agent, or Firm* — Stevenson IP, LLC

(57) ABSTRACT

A neck duster with a disposable bristle attachment including a tapered cylindrical handle having a closed top end and an open bottom end. A bottom handle covering is attached to the bottom end of the handle. A top handle covering is attached to the top end of the handle. At least one disposable bristle attachment includes a disc-shaped base plate and a plurality of bristles. An aperture is disposed through each of the top end of the handle and the top handle covering. An upper hook of a pair of hooks is disposed on a lower surface of the base plate, and a lower hook of the pair of hooks is disposed within the handle proximal the top end and attached to a spring-loaded locking mechanism. The upper hook is engageable with the lower hook. A locking release control is configured to disengage the upper hook from the lower hook.

3 Claims, 4 Drawing Sheets

NECK DUSTER WITH A DISPOSABLE BRISTLE ATTACHMENT

BACKGROUND OF THE INVENTION

Various types of neck dusters are known in the prior art. However, what has been needed is a neck duster with a disposable bristle attachment including a tapered cylindrical handle having a closed top end and an open bottom end. What has been further needed is a bottom handle covering attached to the bottom end of the handle, a top handle covering attached to the top end of the handle, and at least one disposable bristle attachment including a disc-shaped base plate and a plurality of bristles. Lastly, what has been needed is an aperture disposed through each of the top end of the handle and the top handle covering, with an upper hook of a pair of hooks disposed on a lower surface of the base plate and a lower hook of the pair of hooks disposed within the handle proximal the top end and attached to a spring-loaded locking mechanism. The upper hook is removably disposable through the aperture and engageable with the lower hook, and a locking release control is configured to disengage the upper hook from the lower hook. The neck duster with a disposable bristle attachment thus prevents the often common and unsanitary reuse of a neck duster between clients at a barbershop by allowing the disposable bristle attachment to be easily removed and replaced between clients.

FIELD OF THE INVENTION

The present invention relates to neck dusters, and more particularly, to a neck duster with a disposable bristle attachment.

SUMMARY OF THE INVENTION

The general purpose of the present neck duster with a disposable bristle attachment, described subsequently in greater detail, is to provide a neck duster with a disposable bristle attachment which has many novel features that result in a neck duster with a disposable bristle attachment which is not anticipated, rendered obvious, suggested, or even implied by prior art, either alone or in combination thereof.

To accomplish this, the present neck duster with a disposable bristle attachment includes a tapered cylindrical handle, optionally plastic and, alternately, wood, having a closed top end and an open bottom end. A circumference of the top end is greater than a circumference of the bottom end. A disc-shaped bottom handle covering is medially attached to the bottom end of the handle. A circumference of the bottom handle covering is greater than the circumference of the bottom end of the handle, and the circumference of the bottom handle covering is approximately equal to the circumference of the top end of the handle. A disc-shaped top handle covering is medially attached to the top end of the handle. A circumference of the top handle covering is greater than the circumference of the top end of the handle. The greater circumference of both the top handle covering and the bottom handle covering as compared with the top end and the bottom end, respectively, of the handle, is structured to form a pair of lips on the top side and the bottom side that provide a user with a more stable grasp on the handle.

The neck duster with a disposable bristle attachment further includes at least one disposable bristle attachment including a disc-shaped base plate and a plurality of bristles. The disc-shaped base plate has an upper surface and a lower surface, and the plurality of bristles is attached to the upper surface of the base plate. An aperture is medially disposed through each of the top end of the handle and the top handle covering. A pair of selectively interconnectable hooks includes an upper hook and a lower hook. The upper hook is medially disposed on the lower surface of the base plate of the at least one disposable bristle attachment, and the lower hook is disposed within the handle proximal the top end and attached to a spring-loaded locking mechanism disposed within the handle. A locking release control is disposed through the handle proximal the top end, with the locking release control having an inner surface attached to the spring-loaded locking mechanism.

The upper hook is removably disposable through the aperture and selectively engageable with the lower hook, with the base plate of the at least one disposable bristle attachment attached to the top handle covering when the upper hook is engaged with the lower hook. The locking release control is configured to disengage the upper hook from the lower hook and detach the base plate of the at least one disposable bristle attachment from the top handle covering when the user depresses the locking release control. The locking release control thus allows the user to change the at least one disposable bristle attachment after each use in order to ensure that bacteria and other organisms are not passed between people sharing the neck duster.

Thus has been broadly outlined the more important features of the present neck duster with a disposable bristle attachment so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
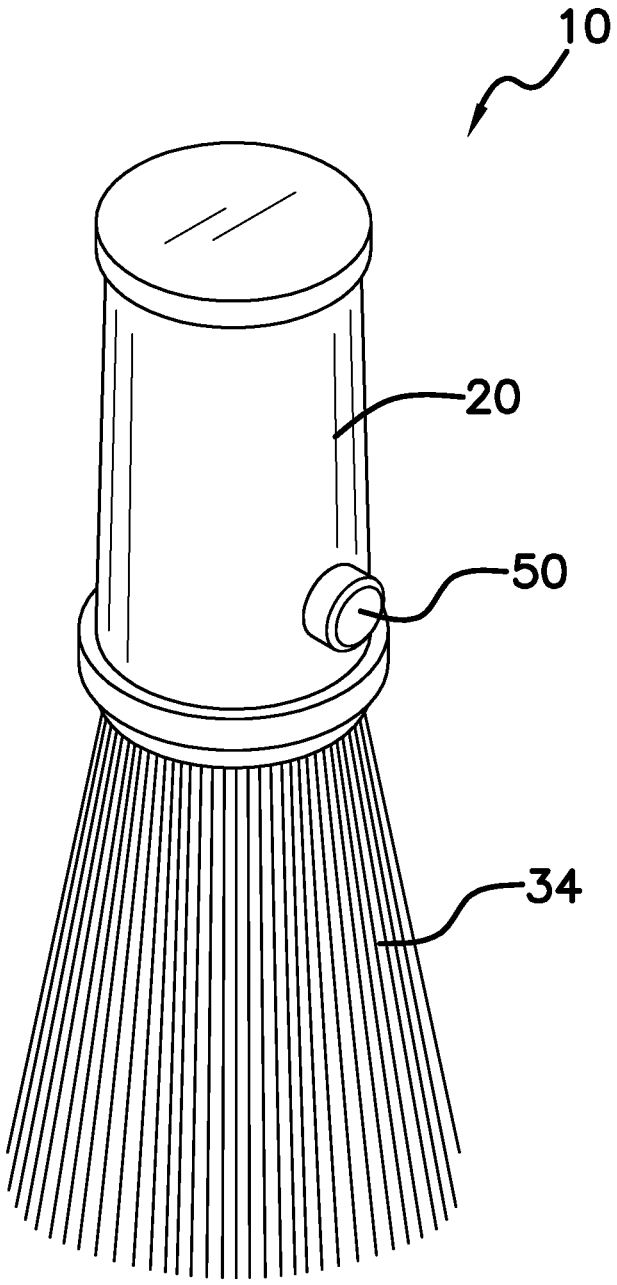
FIG. 1 is a front isometric view.
Figure 2:
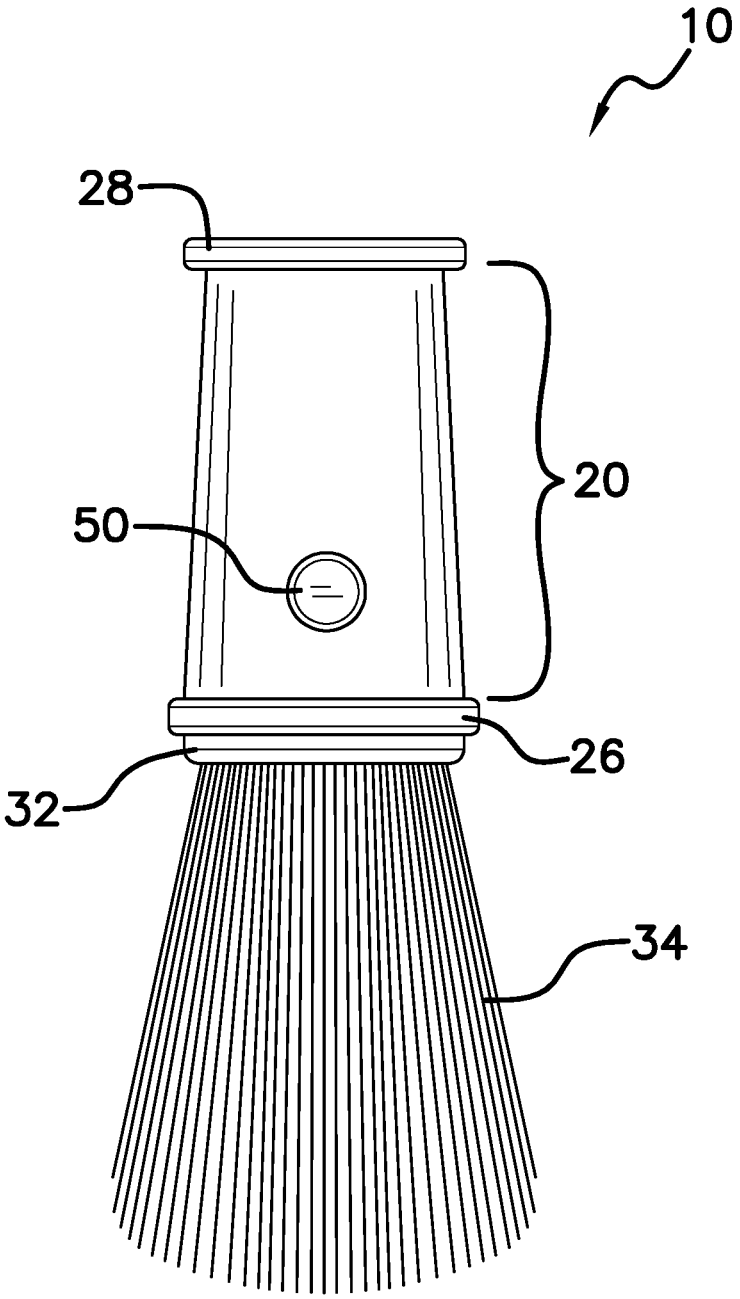
FIG. 2 is a front elevation view.
Figure 3:
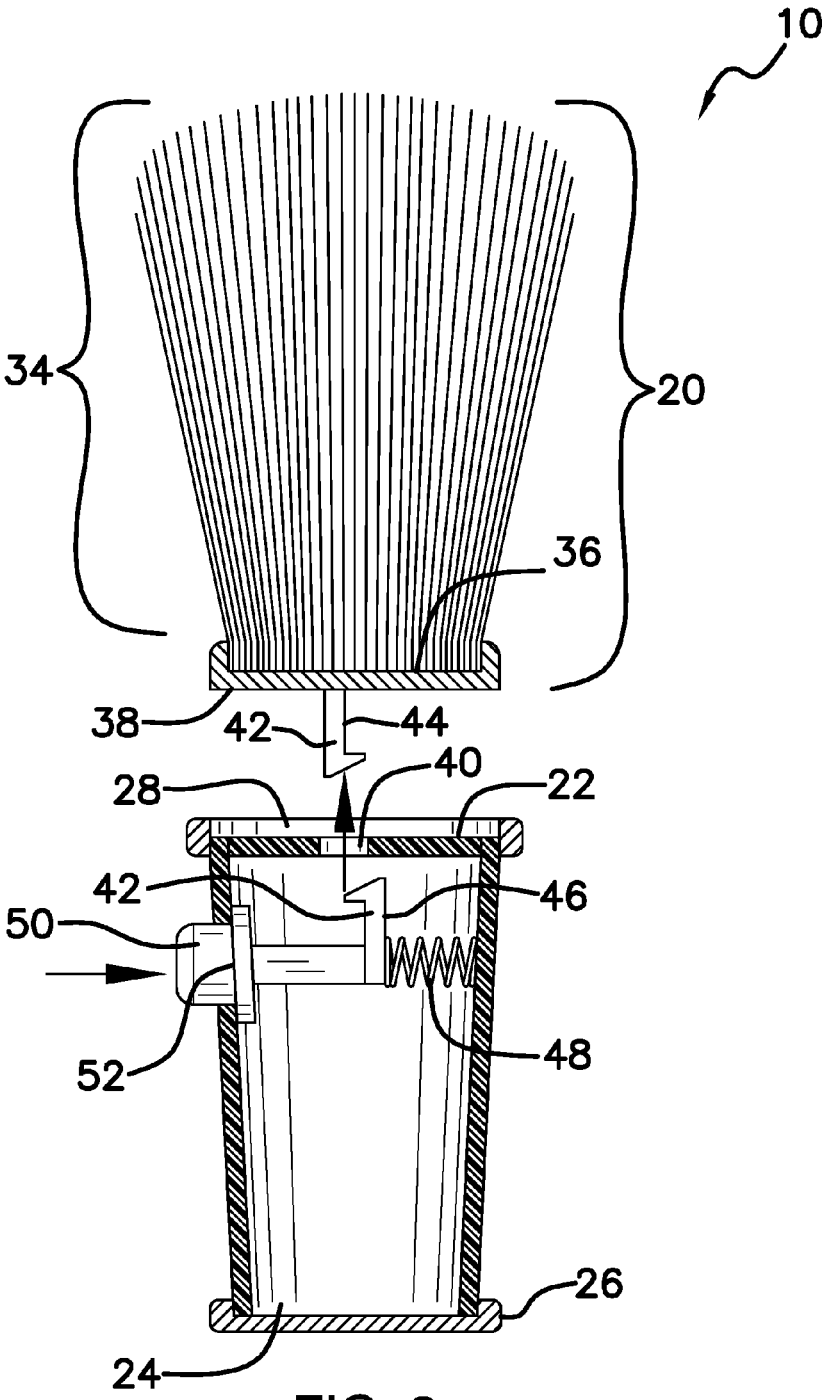
FIG. 3 is a cross-sectional view taken along line 3-3 of FIG. 2.
Figure 4:
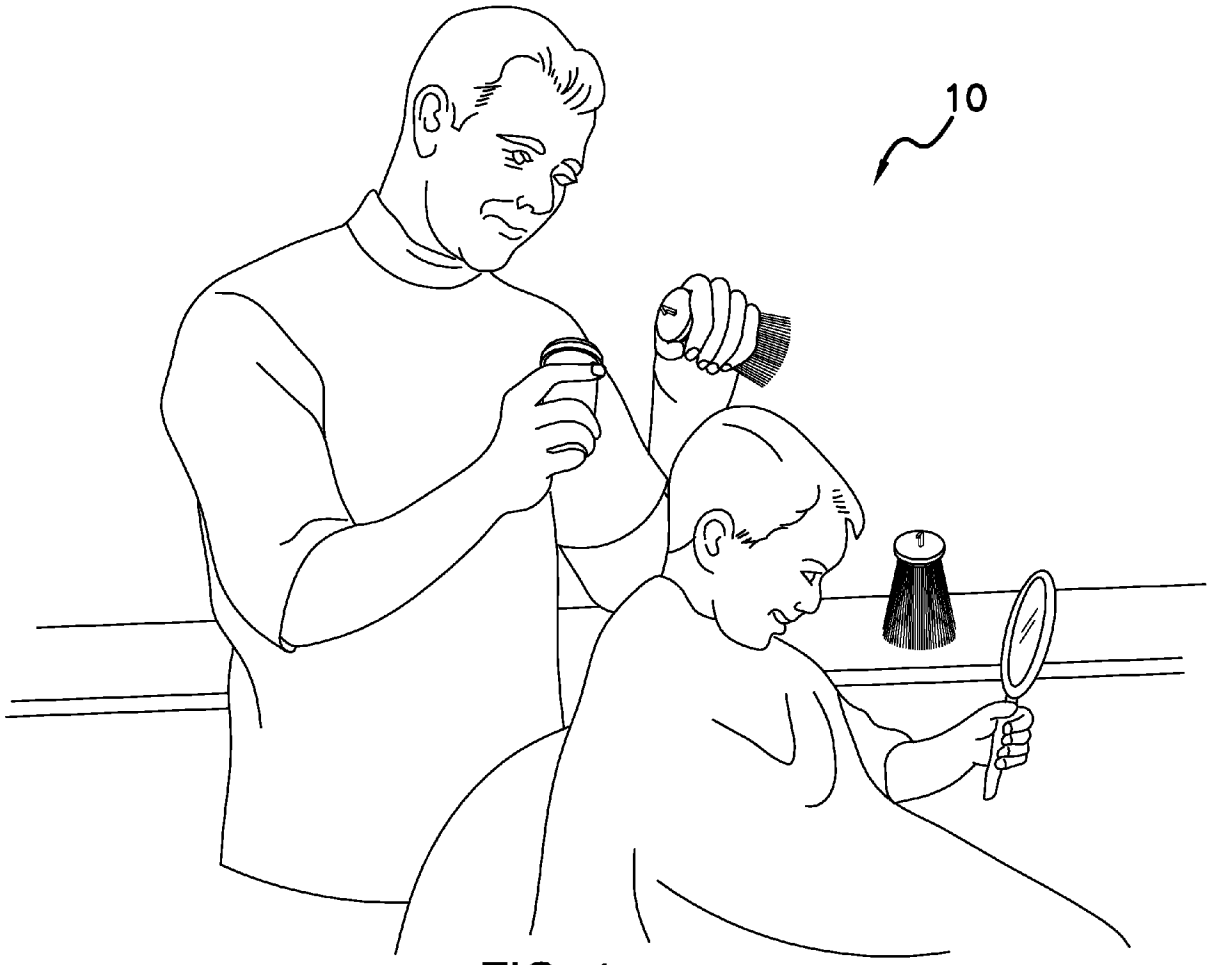
FIG. 4 is an in use view.

With reference now to the drawings, and in particular FIGS. 1 through 4 thereof, an example of the instant neck duster with a disposable bristle attachment employing the principles and concepts of the present neck duster with a disposable bristle attachment and generally designated by the reference number 10 will be described.

Referring to FIGS. 1 through 4 the present neck duster with a disposable bristle attachment 10 is illustrated. The neck duster with a disposable bristle attachment 10 includes a tapered cylindrical handle 20, optionally plastic and, alternately, wood, having a closed top end 22 and an open bottom end 24. A circumference of the top end 22 is greater than a circumference of the bottom end 24. A disc-shaped bottom handle covering 26 is medially attached to the bottom end 24 of the handle 20. A circumference of the bottom handle covering 26 is greater than the circumference of the bottom end 24 of the handle 20, and the circumference of the bottom handle covering 26 is approximately equal to the circumference of the top end 22 of the handle 20. A disc-shaped top handle covering 28 is medially attached to the top end 22 of the handle 20. A circumference of the top handle covering 28 is greater than the circumference of the top end 22 of the handle 20.

The neck duster with a disposable bristle attachment 10 further includes at least one disposable bristle attachment 30 including a disc-shaped base plate 32 and a plurality of bristles 34. The disc-shaped base plate 32 has an upper surface 36 and a lower surface 38, and the plurality of bristles 34 is attached to the upper surface 36 of the base plate 32. An aperture 40 is medially disposed through each of the top end 22 of the handle 20 and the top handle covering 28. A pair of selectively interconnectable hooks 42 includes an upper hook 44 and a lower hook 46. The upper hook 44 is medially disposed on the lower surface 38 of the base plate 32 of the at least one disposable bristle attachment 30, and the lower hook 46 is disposed within the handle 20 proximal the top end 22 and attached to a spring-loaded locking mechanism 48 disposed within the handle 20. A locking release control 50 is disposed through the handle 20 proximal the top end 22, with the locking release control 50 having an inner surface 52 attached to the spring-loaded locking mechanism 48.

The upper hook 44 is removably disposable through the aperture 40 and selectively engageable with the lower hook 46, with the base plate 32 of the at least one disposable bristle attachment 30 attached to the top handle covering 28 when the upper hook 44 is engaged with the lower hook 46. The locking release control 50 is configured to disengage the upper hook 44 from the lower hook 46 and detach the base plate 32 of the at least one disposable bristle attachment 30 from the top handle covering 28 when a user depresses the locking release control 50.

What is claimed is:

1. A neck duster with a disposable bristle attachment comprising:

a tapered cylindrical handle having a closed top end and an open bottom end, wherein a circumference of the top end is greater than a circumference of the bottom end;

a disc-shaped bottom handle covering medially attached to the bottom end of the handle;

wherein a circumference of the bottom handle covering is greater than the circumference of the bottom end of the handle;

wherein the circumference of the bottom handle covering is approximately equal to the circumference of the top end of the handle;

a disc-shaped top handle covering medially attached to the top end of the handle;

wherein a circumference of the top handle covering is greater than the circumference of the top end of the handle;

at least one disposable bristle attachment further comprising:

a disc-shaped base plate having an upper surface and a lower surface;

a plurality of bristles attached to the upper surface of the base plate;

an aperture medially disposed through each of the top end of the handle and the top handle covering;

a pair of selectively interconnectable hooks comprising an upper hook and a lower hook, wherein the upper hook is medially disposed on the lower surface of the base plate of the at least one disposable bristle attachment and the lower hook is disposed within the handle proximal the top end and attached to a spring-loaded locking mechanism disposed within the handle; and a locking release control disposed through the handle proximal the top end, the locking release control having an inner surface attached to the spring-loaded locking mechanism;

wherein the upper hook is removably disposable through the aperture and selectively engageable with the lower hook;

wherein the base plate of the at least one disposable bristle attachment is attached to the top handle covering when the upper hook is engaged with the lower hook;

wherein the locking release control is configured to disengage the upper hook from the lower hook and detach the base plate of the at least one disposable bristle attachment from the top handle covering when a user depresses the locking release control.

2. The neck duster with a disposable bristle attachment of claim 1 wherein the handle is plastic.

3. The neck duster with a disposable bristle attachment of claim 1 wherein the handle is wood.

* * * * *